US007249593B2

(12) United States Patent
Ricco et al.

(10) Patent No.: US 7,249,593 B2
(45) Date of Patent: Jul. 31, 2007

(54) INJECTION SYSTEM FOR AN INTERNAL-COMBUSTION ENGINE

(75) Inventors: Mario Ricco, Valenzano (IT); Sisto Luigi De Matthaeis, Valenzano (IT); Annunziata Anna Satriano, Valenzano (IT); Antonio Gravina, Valenzano (IT); Adriano Gorgoglione, Valenzano (IT)

(73) Assignee: C.R.F. Societa Consortile per Azioni, Orbassano (IT)

( * ) Notice: Subject to any disclaimer, the term of this patent is extended or adjusted under 35 U.S.C. 154(b) by 240 days.

(21) Appl. No.: 11/097,389

(22) Filed: Apr. 4, 2005

(65) Prior Publication Data

US 2006/0000451 A1 Jan. 5, 2006

(30) Foreign Application Priority Data

Jun. 30, 2004 (EP) ..... 04425471

(51) Int. Cl.
*F02M 55/02* (2006.01)

(52) U.S. Cl. ..... 123/456; 123/468

(58) Field of Classification Search ..... 123/456, 123/447, 468, 469, 470
See application file for complete search history.

(56) References Cited

U.S. PATENT DOCUMENTS 4,372,272 A * 2/1983 Walter et al. ..... 123/467
4,440,134 A * 4/1984 Nakao et al. ..... 123/447
4,709,679 A * 12/1987 Djordjevic et al. ..... 123/447
5,642,714 A * 7/1997 Buckley ..... 123/447
5,727,525 A * 3/1998 Tsuzuki ..... 123/447
5,732,679 A * 3/1998 Takahasi et al. ..... 123/467
6,422,203 B1 * 7/2002 Djordjevic ..... 123/456
6,637,408 B2 * 10/2003 Djordjevic ..... 123/456
2003/0094158 A1 5/2003 Maier et al.
2004/0112337 A1 6/2004 Schmidt et al.

FOREIGN PATENT DOCUMENTS

DE 198 42 067 A1 3/2000
DE 102 10 282 A1 9/2003
JP 10030521 2/1998
WO WO 2004/013487 A1 2/2004

* cited by examiner

*Primary Examiner*—Thomas Moulis
(74) *Attorney, Agent, or Firm*—Bernato, White & Stavish

(57) ABSTRACT

A fuel-injection system (1, 1', 1", 1'") for an internal-combustion engine (2), of the type provided with compressor mechanism (4) for making available the fuel at a high pressure to an storage volume (7), and a plurality of injectors (8, 8', 8'") fluidically connected to the storage volume (7) for taking in the fuel from the storage volume (7) and injecting it into respective combustion chambers (12) of the engine (2). The storage volume (7) is advantageously split into a plurality of distinct elementary storage volumes (9, 9', 9*a*, 9*b*) fluidically connected to one another.

5 Claims, 8 Drawing Sheets

INJECTION SYSTEM FOR AN INTERNAL-COMBUSTION ENGINE

BACKGROUND OF THE INVENTION a) Filed of the Invention

The present invention relates to a fuel-injection system for an internal-combustion engine.

b) Background of the Related Art

Known, in the framework of compression-ignition engines for motor vehicles, are injection systems (the so-called common-rail systems) consisting of by a plurality of electro-injectors supplied by a common storage volume of fuel under pressure.

In particular, operation of said injection systems envisages that a low-pressure priming pump will draw the fuel from a tank and will make it available to a high-pressure pump. The high-pressure pump compresses the fuel up to the pressure of injection and makes it available to a common storage volume, which supplies the electro-injectors. A pressure-regulation system enables the desired pressure to be maintained within the storage volume.

One of the functions of the common storage volume is that of dampening the pressure oscillations caused by the delivery of fuel from the high-pressure pump to the storage volume and by the extraction of fuel caused by opening of the electro-injectors.

In detail, the electro-injectors are supplied by the common storage volume and inject the fuel nebulized at high pressure into each of the combustion chambers of the respective engine cylinders.

With reference to the current state of the art, there is felt the need to reduce the volume of the common storage volume in order to meet more satisfactorily current standards on pollutant emission.

In greater detail, in the engine-starting stage, the high-pressure pump is driven by the engine of the motor vehicle, and hence there occurs a transient period, during which the common storage volume is at a pressure lower than the steady-state pressure, and the electro-injectors take in fuel to start the engine itself. The duration of this transient increases as the size of the common storage volume increases. The injection of fuel by the electro-injectors during this transient causes non-optimal operation of the internal-combustion engine and in particular increases the emission of pollutant substances.

Furthermore, the reduction in volume of the common storage volume would enable reduced overall dimensions and a more convenient installation in the internal-combustion engine.

However, the reduction in volume of the storage volume could entail drawbacks in the use of the injection system during steady running conditions. In particular, opening of the electro-injectors causes a pressure drop in the common storage volume. Said pressure drops are dampened by the storage volume in a way that is all the more effective the greater the volume of the storage volume itself. Consequently, in the case where the volume of the storage volume were insufficient to dampen the aforesaid pressure drops, operation of the electro-injectors would be faulty, and the pollutant emissions of the internal-combustion engine would increase.

SUMMARY OF THE INVENTION

The purpose of the present invention is to provide an injection system for an internal-combustion engine which will enable the aforementioned requirements to be met in a simple and economically advantageous way. The aforesaid purpose is achieved by the present invention, in so far as it relates to an injection system for an internal-combustion engine having a compressor mechanism for making available fuel at a high pressure to a storage volume; and at least one injector fluidically connected to the storage volume for taking in fuel at a high pressure from the storage volume and injecting it into respective combustion chambers of the engine. The system is characterised in that the storage volume is split into at least two distinct elementary storage volumes fluidically connected to one another.

BRIEF DESCRIPTION OF THE DRAWINGS

For a better understanding of the present invention, described in what follows are four preferred embodiments, which are provided purely by way of non-limiting examples and with reference to the attached plate of drawings, in which.

DETAILED DESCRIPTION OF THE PREFFERED EMBODIMIENT

Figure 1:
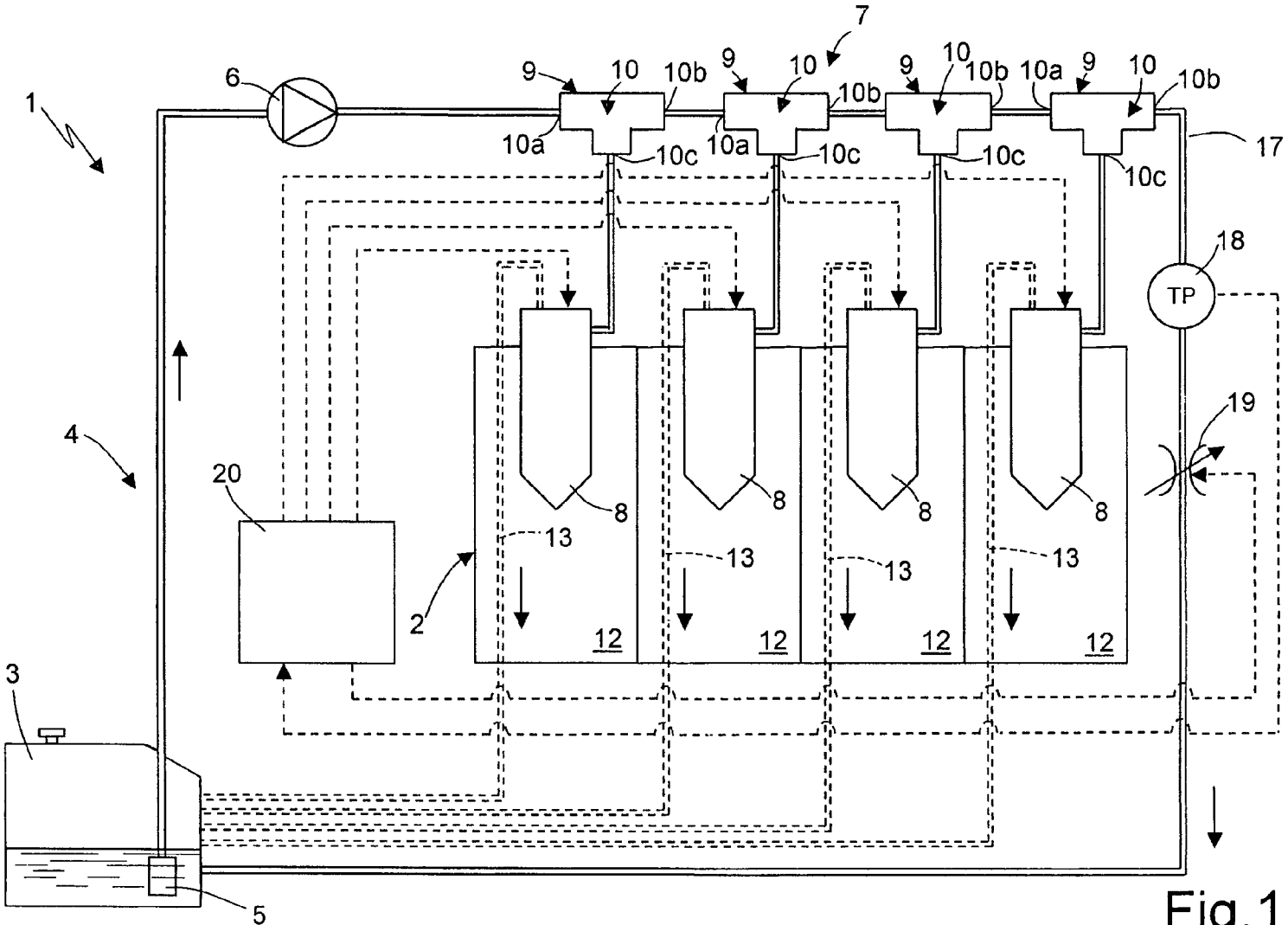
FIG. 1 is a diagram of an injection system for an internal-combustion engine made according to the teachings of the present invention.

With particular reference to FIG. 1, designated as a whole by 1 is an injection system for an internal-combustion engine 2, in itself known and illustrated only partially.

The system 1 basically comprises: a tank 3 for the fuel; a compressor assembly 4 for making available the fuel at a high pressure to an storage volume 7; a plurality of electro-injectors 8 fluidically connected to the storage volume 7 for taking in the fuel at a high pressure from the storage volume 7 itself and injecting it into respective combustion chambers 12 of the engine 2; and a pressure regulator 19 for correcting the value of the injection pressure with respect to the operating conditions of the engine 2, i.e., for adjusting the pressure of the fuel inside the storage volume 7 given the same pressure of the fuel delivered by the compressor assembly 4 to the storage volume 7 itself.

In the case in point illustrated, the compressor assembly 4 comprises a low-pressure pump 5 immersed in the fuel contained in the tank 3, and a high-pressure pump 6, which supplies the storage volume 7 directly and, hence, the electro-injectors 8.

The injection system 1 further comprises a control unit 20 for regulating, through an appropriate system of a type in itself known, the delivery pressure of the high-pressure pump 6 and opening of the electro-injectors 8. More in particular, the control unit 20, on the basis of the operating conditions imposed on the internal-combustion engine 2, determines the delivery pressure of the pump 6 and the time interval of injection of the fuel.

According to an important aspect of the present invention, the storage volume 7 is split into a plurality of distinct elementary storage volumes 9, which are fluidically connected to one another. In the case in point illustrated, the aforesaid elementary storage volumes 9 number four, each of which supplies a respective electro-injector 8, described in detail in what follows.

Advantageously, in the embodiment of FIG. 1, each elementary storage volume 9 is set outside the respective electro-injector 8 and supplies it by means of a hydraulic connection that is as short as possible, for example, one having a length of less than 100 mm. Each elementary storage volume 9 can be for example defined by a wye 10 comprising a first through tubular portion defining, at one end, a first opening 10*a* for intake of the fuel and, at the opposite end, a second opening 10*b* for outlet of the fuel. Each wye 10 moreover has a second tubular portion extending orthogonally in cantilever fashion in an intermediate position from the first tubular portion for drawing, via a third, end, opening 10*c*, the fuel into the respective electro-injector 8.

In the case in point illustrated, the elementary storage volumes 9 are set in succession on the delivery line of the high-pressure pump 6. In particular, a first elementary storage volume 9 is connected directly to the high-pressure pump 6 via the opening 10*a*, a second elementary storage volume 9 is connected to the tank 3 via a return line 17 for return of the fuel coming out of the corresponding opening 10*b*, and the other two elementary storage volumes 9 are set between the aforesaid first and second elementary storage volumes 9 and have their respective openings 10*a*, 10*b* connected to the adjacent elementary storage volumes 9 set upstream and downstream, respectively.

The pressure regulator 19 consists of a solenoid valve with variable section for passage of fluid set along the line 17 and is controlled in a known way by the control unit 20 for varying the amount of fuel present in the storage volume 7 and, hence, the injection pressure.

Advantageously, the pressure regulator 19 is set on the line 17 downstream of the global storage volume 7 so as to enable a continuous flow of the fuel through the storage volume 7 itself even in conditions of absence of injection and, consequently, so as to limit the pressure oscillations that are created following upon each injection into the corresponding electro-injector 8 in order to bring such electro-injector back again into the pressure conditions required for the subsequent injection.

As may be seen in FIG. 1, the pressure regulator 19 is associated in a known way to a pressure transducer 18, which is designed to supply the control unit 20 with the pressure values detected along the fuel-return line 17 and is set upstream of the pressure regulator 19 itself.

Figure 5:
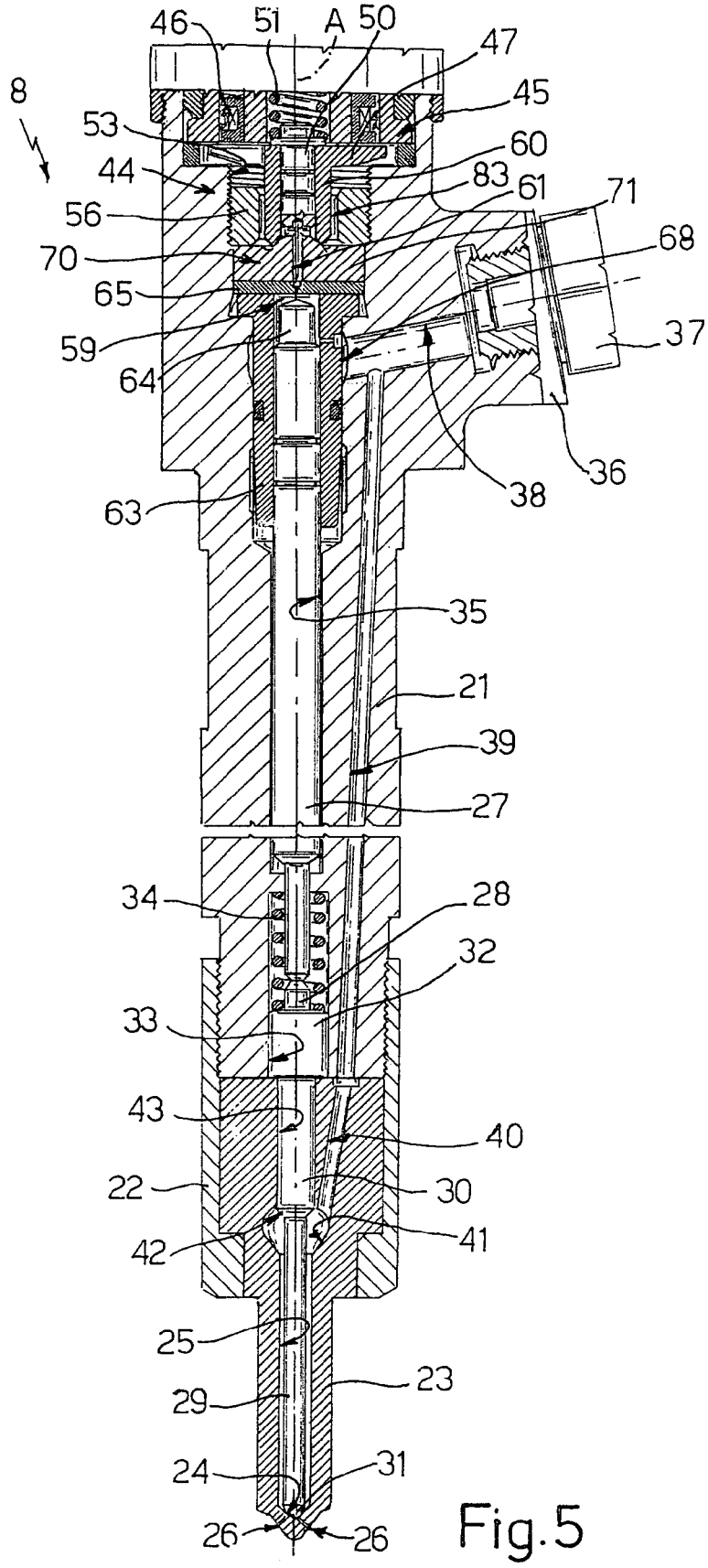
FIG. 5 is a cross-sectional view, at an enlarged scale, of an injector of the injection system of FIG. 1.
Figure 6:
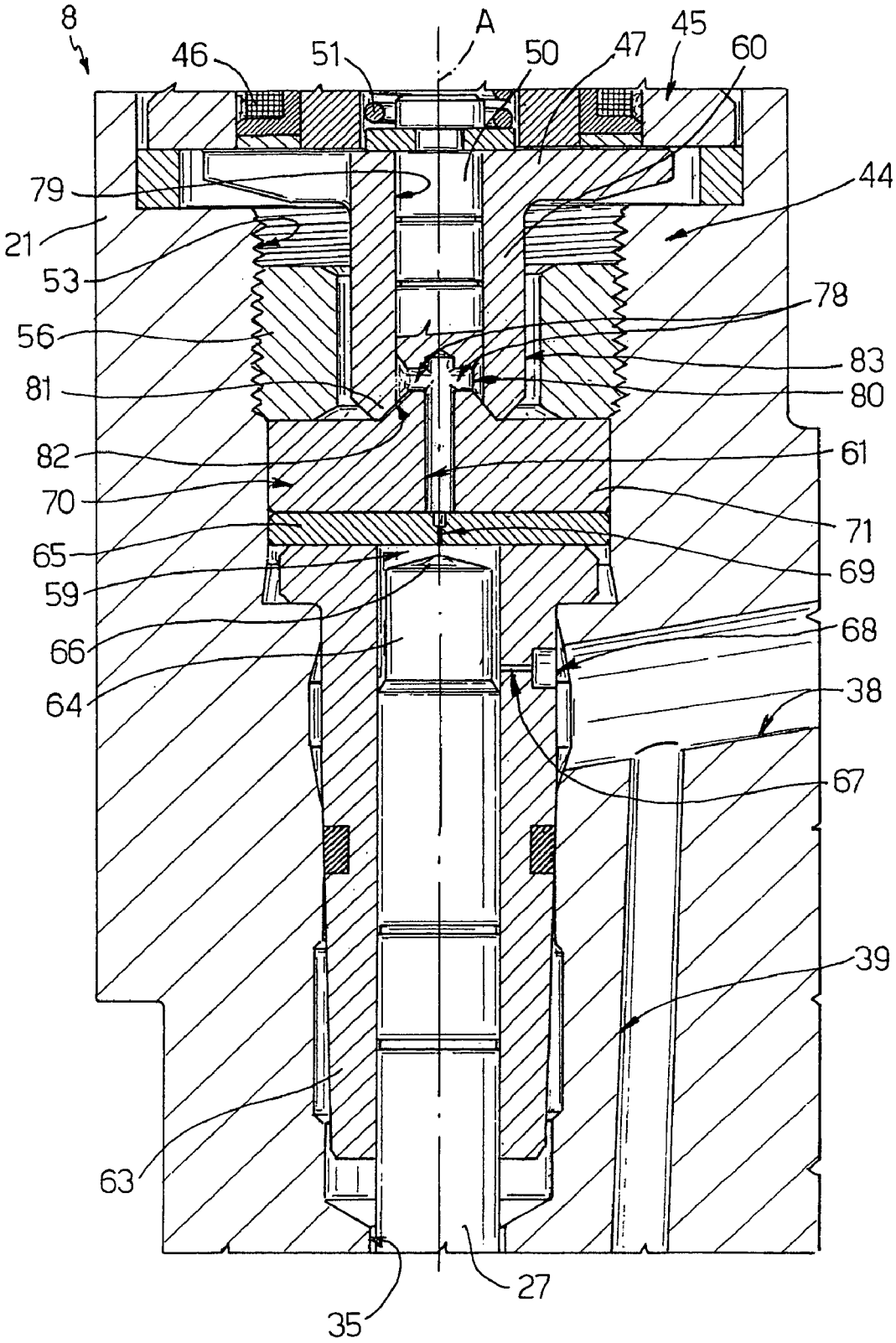
FIG. 6 illustrates, at a further enlarged scale, a detail of the injector of FIG. 5.

With particular reference to FIGS. 5 and 6, each electro-injector 8 has an axis A and comprises a hollow body 21 coupled, via a ring-nut 22, to a nozzle 23. The nozzle 23 is provided with an axial hole 25 and terminates with a conical seat 24, arranged in which is a plurality of injection holes 26 communicating with the respective combustion chamber 12 of the engine 2. The body 21 is provided with an axial hole 35, in which a rod 27 for controlling injection of the fuel through the nozzle 23 is able to slide.

The hollow body 21 moreover has a side appendage 36, inserted in which is a connector 37 defining a fuel-inlet mouth connected to the opening 10*c* of the respective elementary storage volume 9. The appendage 36 has a hole 38 in communication, via a feed pipe 39 made inside the body 21 and a feed pipe 40 made inside the nozzle 23, with an injection chamber 41 of an annular shape, provided in the nozzle 23 itself and in communication with the axial hole 25.

One end of the rod 27 is set bearing upon one end 28 of a pin 29, which is able to slide in the axial hole 25 for opening/closing the holes 26. The pin 29 moreover has an opposite conical end 31 designed to engage the conical seat 24 of the nozzle 23. In greater detail, the pin 29 comprises a portion 30 guided, in a fluid-tight way, in a portion 43 of the hole 25 of the nozzle 23.

On the portion 30, towards the end 28, there acts a collar 32 guided in a cylindrical seat 33 of the body 21. The collar 32 is normally pushed towards the seat 24 by a spring 34, which contributes to keeping the holes 26 closed. The opposite end of the portion 30 terminates with a shoulder 42, on which the fuel under pressure in the chamber 41 acts.

The pin 29 has a pre-set play with respect to an internal wall of the hole 25 of the nozzle 23. This play is designed to guarantee a fast outflow of the fuel contained in the chamber 41 towards the holes 26 of the nozzle 23. Normally, the volume of the chamber 41 is smaller than the maximum amount of fuel that the electro-injector 8 has to inject. The feed pipes 39 and 40 are hence sized in such a way as to enable filling of the chamber 41 with the fuel also during the step of injection of the fuel itself into the respective combustion chamber 12.

The hollow body 21 moreover houses, in an axial end cavity 53 of its own, which communicates with the hole 35 and is set on the opposite side of the nozzle 23, a control servo-valve 44 comprising, in turn, an actuator device 45, which is coaxial with the rod 27 and is provided with an electromagnet 46. The servo-valve 44 further comprises: an anchor 47, which has a sectored configuration and is axially slidable in the hollow body 21 under the action of the electromagnet 46; and a pre-loaded spring 51, which is surrounded by the electromagnet 46 and exerts an action of thrust on the anchor 47 in a direction opposite to the attraction exerted by the electromagnet 46 itself.

The servo-valve 44 comprises a control chamber 59 made in a cylindrical tubular guide element 63, which is in turn housed in a portion of the hole 35 adjacent to the appendage 36 and inside which a piston-shaped portion 64 of the rod 27 is able to slide in a fluid-tight way.

More in particular, the chamber 59 is axially delimited between a terminal surface 66 of the portion 64 of the rod 27 and an end disk 65 housed inside the cavity 53 of the hollow body 21 in a fixed position between the actuator device 45 and the guide element 63.

The chamber 59 communicates permanently with the hole 38 for receiving fuel under pressure through a radial calibrated pipe 67 made in the guide element 63 and an annular groove 68 of the hollow body 21, which surrounds a portion of the guide element 63 itself.

The chamber 59 moreover communicates, via a calibrated pipe 69 sharing the axis A of the disk 65, with a further chamber 61, which also shares the same axis A and is made in a distribution body 70 set in an intermediate axial position between the disk 65 itself and the actuator device 45.

The body 70 comprises a base 71 axially packed tight against the disk 65, in a fluid-tight way and in a fixed position, by means of a ring-nut 56 screwed to an internal surface of the cavity 53 of the hollow body 21 and axially coupled so that it bears upon an external annular portion of the base 71 itself. The body 70 further comprises a stem or pin 50, which extends in cantilever fashion from the base 71 along the axis A in a direction opposite to the chamber 59, is delimited on the outside by a cylindrical side surface 79, and is made of a single piece with the base 71.

In detail, the chamber 61 extends through the base 71 and part of the stem 50 and communicates, on diametrally opposite sides, with respective radial holes 78 of the stem 50 itself. The holes 78 give out, in an axial position adjacent to the base 71, into an annular chamber 80 dug along the surface 79.

The chamber 80 defines, in a radially external position, an annular gap or port designed to be opened/closed by an open/close element defined by a sleeve 60 actuated by the actuator device 45 for varying the pressure in the control chamber 59 and, hence, controlling opening and closing of the holes 26 of the injection nozzle 23 by means of the axial translation of the rod 27.

The sleeve 60 is made of a single piece with the anchor 47 and has an internal cylindrical surface coupled to the surface 79 substantially in a fluid-tight way so as to slide axially between an advanced end-of-travel position and a retracted end-of-travel position.

In particular, in the advanced end-of-travel position, the sleeve 60 closes the external annular gap of the chamber 80 by being coupled so that it bears, at one end 81 of its own ends, upon a conical shoulder 82, which connects the surface 79 of the stem 50 to the base 71. In this position, the fuel exerts a zero resultant force of axial thrust on the sleeve 60, since the pressure in the chamber 80 acts radially on the internal cylindrical surface of the sleeve 60 itself.

In the retracted end-of-travel position, the end 81 of the sleeve 60 is set at a distance from the shoulder 82 and delimits therewith a gap for passage of the fuel towards an annular channel 83 delimited by the ring-nut 56 and by the sleeve 60 itself. The annular channel 83 communicates, through the cavity 53 of the hollow body 21, with a respective exhaust pipe 13 (illustrated in FIG. 1) so as to enable outflow of the fuel towards the tank 3.

The pressurized fuel in the chamber 59 acts on the terminal surface 66 of the portion 64 of the rod 27. Thanks to the fact that the area of the surface 66 of the rod 27 is greater than that of the shoulder 42, the pressure of the fuel, with the aid of the spring 34, normally keeps the rod 27 in a lowered position and the end 31 of the pin 29 in contact with the conical seat 24 of the nozzle 23, thus closing the injection holes 26.

In use, the fuel present in the tank 3 is taken in and pre-compressed by the low-pressure pump 5 and further compressed by the high-pressure pump 6 up to the pressure imposed by the control unit 20.

With particular reference to the steady running conditions of the engine 2, the fuel delivered by the high-pressure pump 6 fills all the elementary storage volumes 9 and the return line 17.

Furthermore, the fuel, through the opening 10*c* of each elementary storage volume 9, supplies each electro-injector 8 via the respective inlet connector 37. In particular, the fuel fills the hole 38 of the appendage 36 and from this supplies, on the one hand, the feed pipe 39 of the body 21, the feed pipe 40 of the nozzle 23 and the injection chamber 41, and, on the other hand, the annular groove 68, the calibrated pipe 67, the control chamber 59 and the annular chamber 80 through the calibrated pipe 69, the chamber 61 and the holes 78.

When the control unit 20 excites the electromagnet 46 of one of the electro-injectors 8, the sleeve 60 of the anchor 47 displaces by compression the spring 51 into the retracted end-of-travel position. Consequently, the end 81 of the sleeve 60 sets itself at a distance from the shoulder 82 so as to open up a gap for passage of the fuel from the chamber 80 towards the annular channel 83 and hence towards the respective exhaust pipe 13.

The pressure of the fuel in the control chamber 59 decreases in so far as the calibrated fuel-inlet pipe 67 itself is not able to restore the flow discharged from the annular chamber 80 towards the tank 3. In turn, the pressure of the fuel in the injection chamber 41 overcomes the residual pressure on the terminal surface 66 of the rod 27 and causes displacement upwards of the pin 29 so that through the holes 26 the fuel is injected from the chamber 41 into the respective combustion chamber 12.

When the control unit 20 interrupts excitation of the electromagnet 46 of one of the electro-injectors 8, the spring 51 pushes the sleeve 60 of the anchor 47 towards the advanced end-of-travel position. Consequently, the end 81 of the sleeve 60 sets itself bearing upon the conical shoulder 82 so as to close the external annular gap of the chamber 80 and hence prevent the passage of fuel towards the respective exhaust pipe 13. The pressurized fuel entering through the connector 37 restores the pressure in the control chamber 59 so that the pin 29 re-closes the holes 26, interrupting injection into the respective combustion chamber 12.

The fuel that flows in the line 17 traverses the pressure transducer 18, which has an output connected to the control unit 20. The aforesaid control unit 20 holds in memory, according to the operating conditions of the engine 2, the correct values of injection pressure and the times of excitation of each control electromagnet 45 for controlling the electro-injector 8 necessary for injecting the desired amount of fuel into the individual combustion chambers 12.

In greater detail, should the pressure value indicated by the transducer 18 be higher than the correct value stored in the control unit 20, the control unit 20 itself issues a command for increase of the section of passage of the pressure regulator 19. In this way, the flow rate present in the line 17 increases, thus draining a greater amount of fuel from the elementary storage volumes 9. Consequently, the pressure prevailing in each elementary storage volume 9 and the pressure of injection into each combustion chamber 12 decrease.

In a similar way, should the pressure value indicated by the transducer 18 be lower than the correct value stored in the control unit 20, the control unit 20 itself issues a command for reduction of the section of passage of the pressure regulator 19. In this way, the flow rate present in the line 17 decreases, thus draining a smaller amount of fuel from the elementary storage volumes 9. Consequently, the pressure prevailing in each elementary storage volume 9 and the pressure of injection into each combustion chamber 12 increase.

Figure 2:
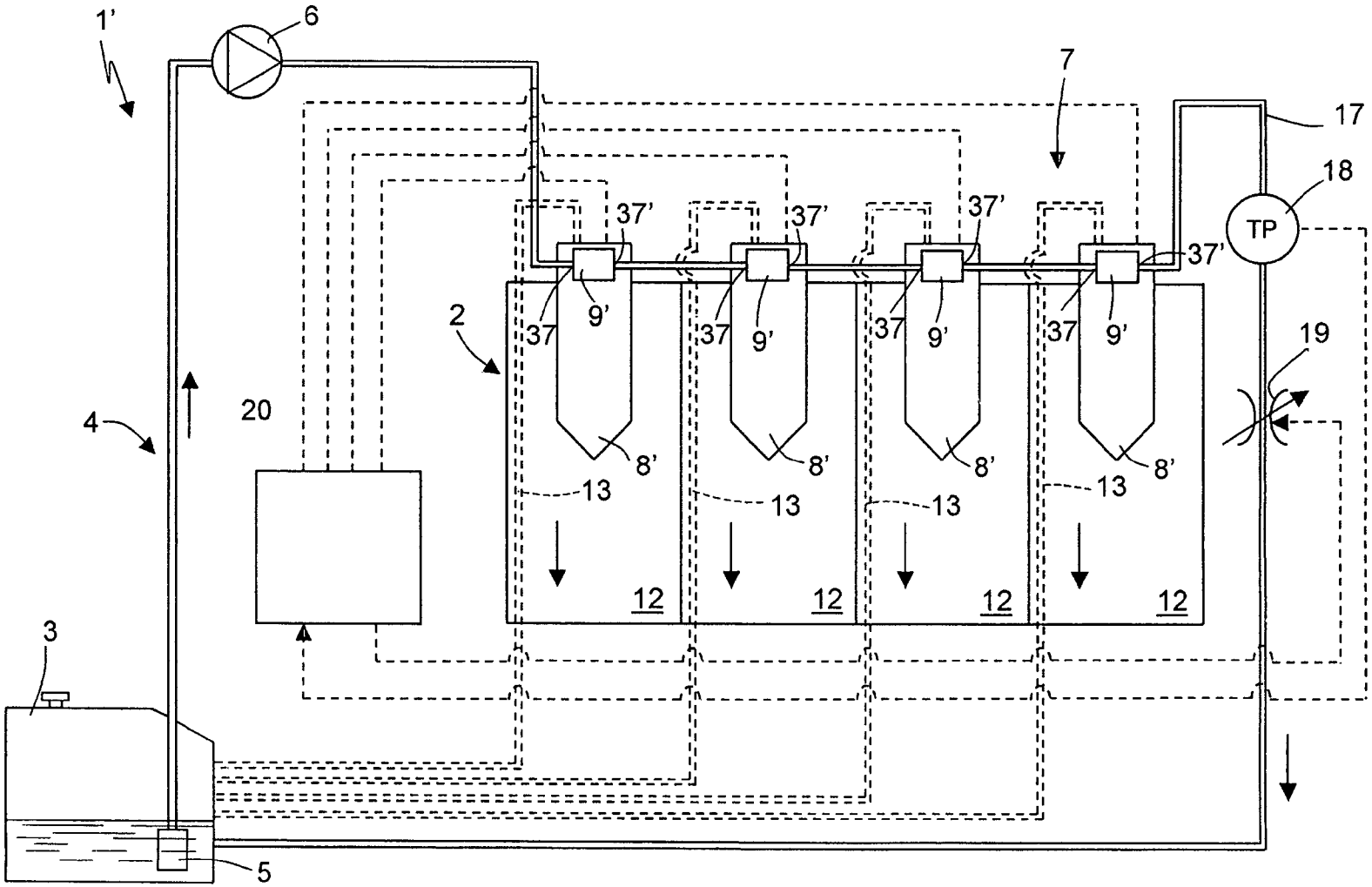
FIG. 2 is a diagram similar to that of FIG. 1 and illustrates a different embodiment of an injection system according to the present invention.

With reference to FIG. 2, designated as a whole by 1' is an injection system according to a different embodiment of the present invention. The injection system 1' is similar to the injection system 1 and will be described in what follows only as regards the aspects that differ from the latter. Corresponding or equivalent parts of the injection systems 1 and 1' will be designated, wherever possible, by the same reference numbers.

In particular, the system 1' comprises an storage volume 7 advantageously divided into a plurality of elementary storage volumes 9' distinct from one another and fluidically connected, each of which is made within a respective electro-injector 8' and supplies the respective combustion chamber 12.

Figure 7:
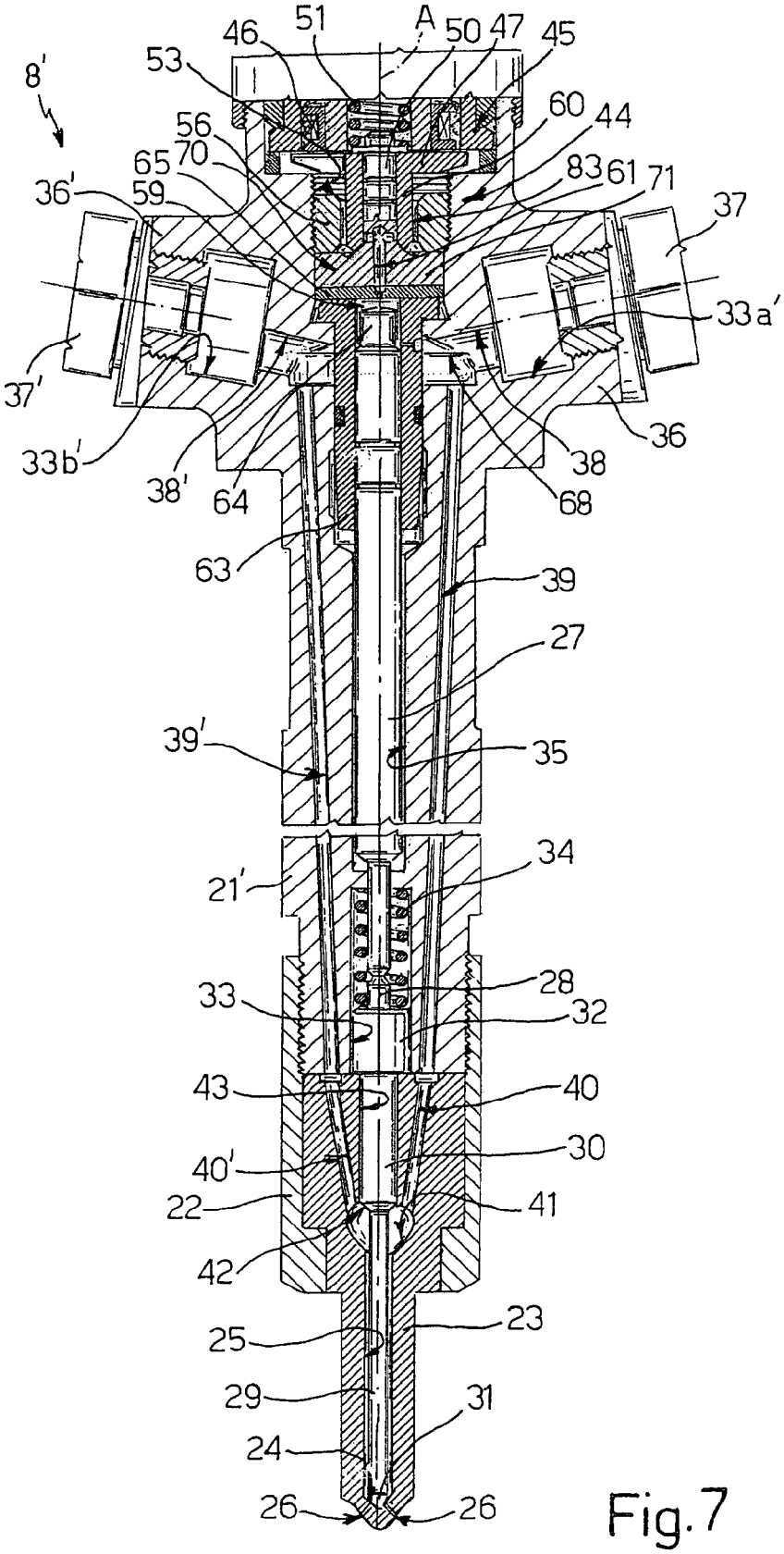
FIG. 7 is a cross-sectional view, at an enlarged scale, of an injector of the systems illustrated in FIGS. 2 and 3.

In the case in point illustrated (FIG. 7), each elementary storage volume 9' is obtained by:

providing, in each electro-injector 8', a pipe 39' and a pipe 40' arranged for example symmetrically on the opposite side of the axis A with respect to the pipes 39 and 40 and converging into the injection chamber 41;

creating a pair of accumulation chambers 33*a'*, 33*b'* respectively in the appendage 36 and in an appendage 36' made on the hollow body 21' on the opposite side of the appendage 36 itself;

enlarging the annular groove 68; and connecting the groove 68 itself to the pipes 39, 40, 39', 40' and to the accumulation chambers 33*a'* and 33*b'*.

In particular, the chamber 33*a'* is made along the hole 38 by enlarging as much as possible the section of passage of the fuel. The chamber 33*b'* is made in a way altogether similar along a hole 38' of the appendage 36' connected, via a connector 37', to a fluid load and to the annular groove 68. The connector 37' consequently defines a mouth for the electro-injector 8'.

In greater detail, each elementary storage volume 9' is constituted by the holes 38, 38', the chambers 33*a'*, 33*b'*, the pipes 39, 39', 40, 40', the injection chamber 41 and the annular groove 68.

In the case in point illustrated, the individual electro-injectors 8' are set in succession on the delivery line of the high-pressure pump 6. In particular, a first electro-injector 8' is connected directly to the high-pressure pump 6 via the connector 37, a second electro-injector 8' is connected to the pressure regulator 19 via the line 17 coming out of the corresponding connector 37', and the other electro-injectors 81 are set between the aforesaid first and second electro-injectors 8' and have the respective connectors 37, 37' connected to the adjacent electro-injectors 8' set upstream and downstream, respectively.

The particular configuration of the electro-injectors 8' described, in combination with the location of the pressure regulator 19 downstream of the global storage volume 7, enables continuous circulation of the fuel through the electro-injectors 8' themselves and, hence, through the entire system 1'.

According to a possible alternative (not illustrated), the chamber 33*b'* and the pipes 39', 40' could be connected just to the injection chamber 41 and not to the annular groove 68.

Operation of the injection system 1' is in all respects identical to that of the injection system 1 and consequently will not be described herein.

Figure 3:
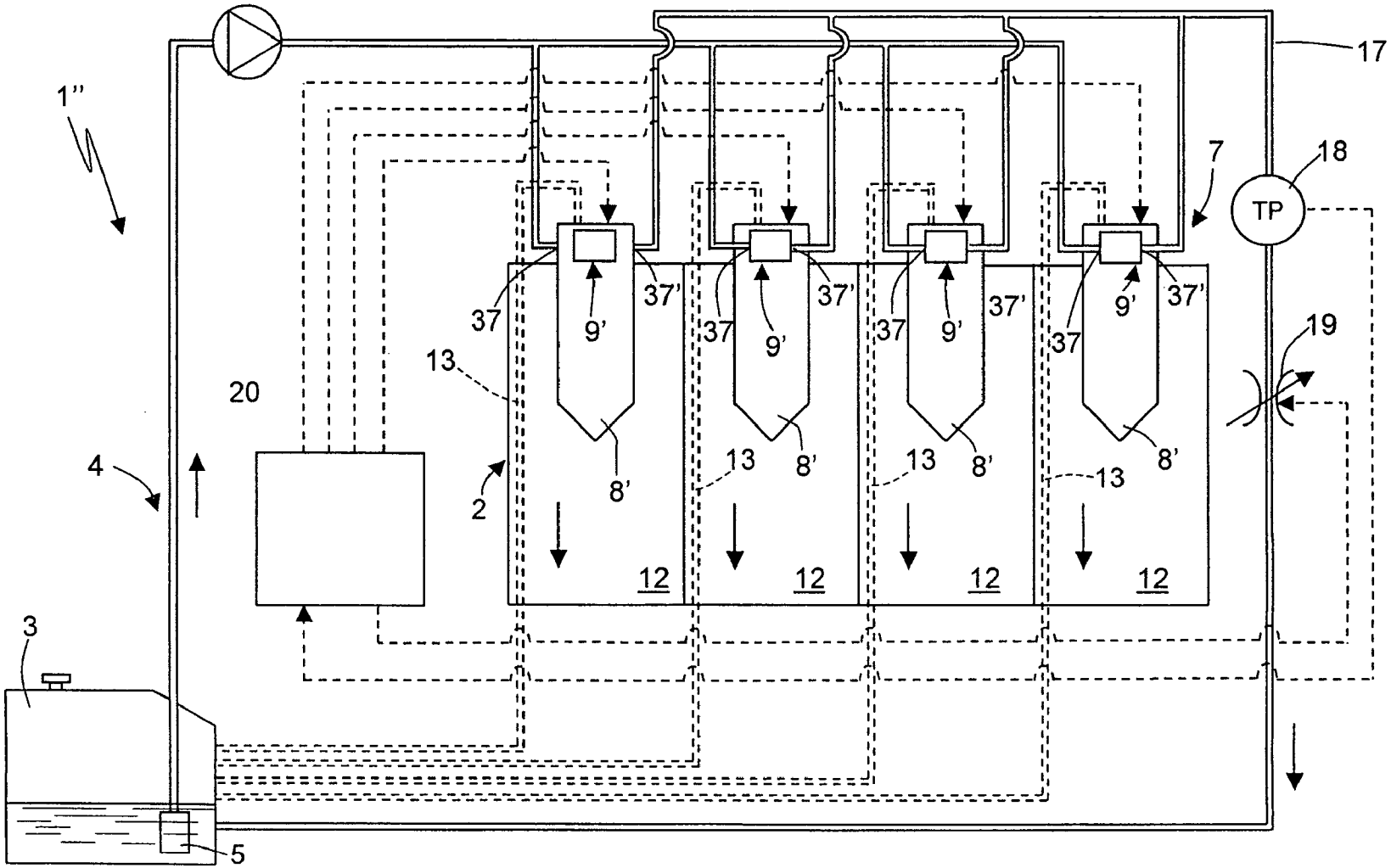
FIG. 3 is a diagram similar to that of FIG. 1 and illustrates another embodiment of an injection system according to the present invention.

With reference to FIG. 3, designated as a whole by 1" is an injection system according to a different embodiment of the present invention. In particular, the injection system 1" differs from the injection system 1' simply in that the inlet connectors 37 of the electro-injectors 8' are supplied by the delivery of the pump 6, whilst the connectors 37' for the electro-injectors 8' are fluidically connected to one another and converge into the line 17.

Figure 4:
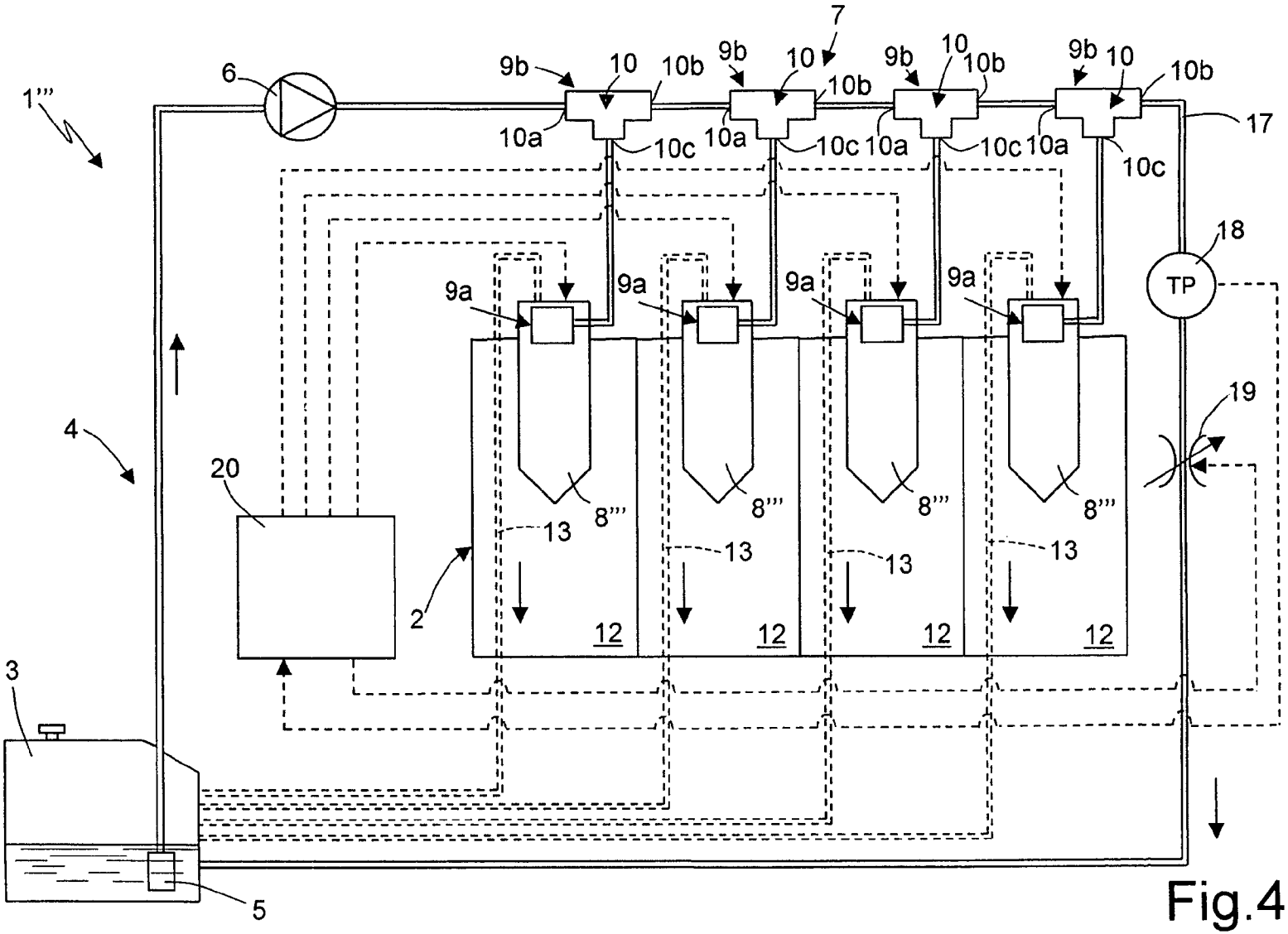
FIG. 4 is a diagram similar to that of FIG. 1 and illustrates yet a further embodiment of an injection system according to the present invention.

With reference to FIG. 4, designated as a whole by 1'" is an injection system according to a different embodiment of the present invention. The injection system 1'" is similar to the injection system 1 and will be described in what follows only as regards the aspects that differ from the latter.

Corresponding or equivalent parts of the injection systems 1 and 1'" will be designated, wherever possible, by the same reference numbers.

In particular, the storage volume 7 is split into a first series of elementary storage volumes 9*a* set within respective electro-injectors 8'" and a second series of elementary storage volumes 9*b* set on the outside the electro-injectors 8'" themselves.

In practice, the storage volume corresponding to each electro-injector 8'" is made partly on the inside and partly on the outside.

Figure 8:
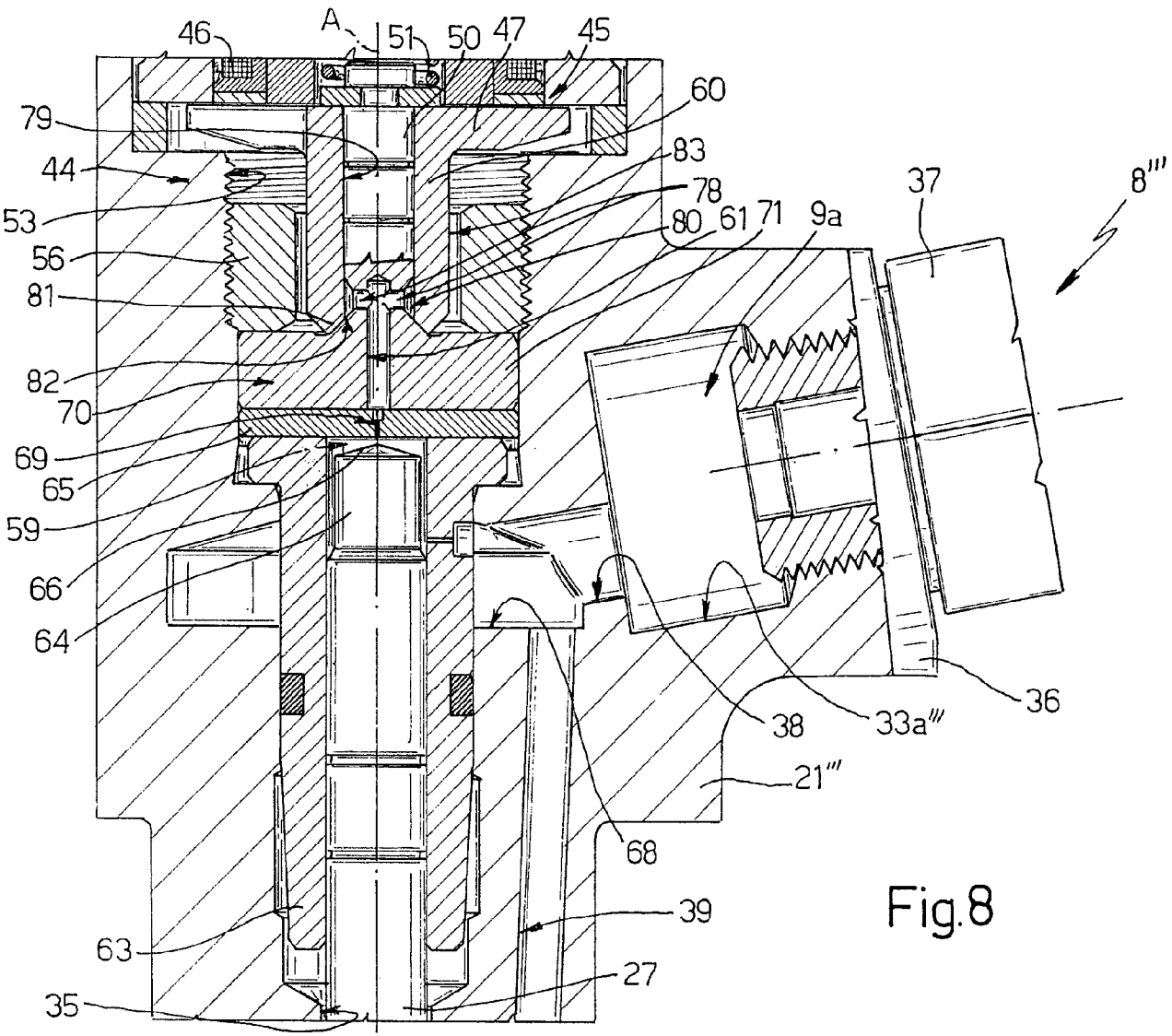
FIG. 8 is a cross-sectional view, at an enlarged scale, of an injector of the system illustrated in FIG. 4, with parts removed for reasons of clarity.

A possible example of the configuration of the electro-injectors 8'" is illustrated in FIG. 8. As may be seen in said figure, the corresponding elementary storage volume 9*a* set within each electro-injector 8'" is obtained, with respect to the electro-injectors 8, by enlarging the annular groove 68 and creating an accumulation chamber 33*a'"* in the appendage 36 along the hole 38.

In practice, the elementary storage volume 9*a* in each electro-injector 8'" is defined by the hole 38, the chamber 33*a'"*, the pipes 39 and 40, the injection chamber 41 and the enlarged annular groove 68.

The elementary storage volume 9*b* set outside each electro-injector 8'" can be advantageously contained in a wye 10 (FIG. 4) of the same type as the ones illustrated in FIG. 1 and set as close as possible to the electro-injector 8'" itself.

According to a possible variant (not illustrated), the electro-injectors 8'" could be provided with pipes similar to the pipes 39', 40' of the electro-injectors 8' and could connect the enlarged annular groove 68 to the injection chamber 41 on the opposite side of the pipes 39, 40.

According to a further possible variant (not illustrated), the electro-injectors 8'" could be provided with an additional connector similar to the connector 37'" of the electro-injectors 8'" and connected just to the annular groove 68. From an examination of the characteristics of the injection systems 1, 1', 1", 1'" made according to the present invention, the advantages that this enables are evident.

In particular, thanks to the splitting of the storage volume 7 into a plurality of elementary storage volumes 9, 9', 9*a*, 9*b* that are distinct and fluidically connected, it is possible to improve the operation of the engine 2 and contain the pollutant emissions during the starting transient and during the steady running conditions.

In greater detail, during the starting transient, the elementary storage volumes 9, 9', 9*a*, 9*b* are rapidly filled by the fuel, in so far as they globally have a smaller capacity than the storage volume normally employed, and rapidly reach the correct injection pressure. Consequently, at the moment of starting of the engine 2, the injection of fuel by the injectors 8, 8', 8'" into the combustion chambers 12 takes place in correct conditions, so improving the efficiency of the engine 2 and reducing the emission of pollutant substances at the exhaust.

Furthermore, the elementary storage volumes 9, 9', 9*a*, 9*b*, which are characterized by particularly small overall dimensions, can be more easily positioned inside the systems 1, 1', 1", 1'" and may even be obtained completely inside the corresponding electro-injectors 8'.

In addition, in the steady-state conditions of the engine 2, the elementary storage volumes 9, 9', 9*a*, 9*b*, albeit of reduced capacity, enable dampening of the pressure oscillations induced by opening of the electro-injectors 8, 8', 8" inside the elementary storage volumes themselves, on account of the small distance of said storage volumes 9, 9', 9*a*, 9*b* from the holes 26. In this way, operation of the engine 2 is correct, and the emission of pollutant substances in the exhaust remains contained.

Finally, it is clear that modifications and variations may be made to the injection systems 1, 1', 1", 1'" described and illustrated herein, without thereby departing from the sphere of protection of the ensuing claims.

In particular, the injection systems described could even include a single electro-injector. In this case, the storage volume 7 would be split into at least two elementary storage volumes, one, 9*a*, set inside the electro-injector itself and the other, 9*b*, outside and in a position close to the latter.

The invention claimed is:

1. A fuel-injection system for an internal combustion engine, comprising:

a fuel tank, fuel delivery means for compressing at a high pressure fuel received from said tank, a plurality of injectors for injecting said fuel at high pressure into respective combustion chambers of said engine, and a plurality of distinct storage volumes hydraulically connected with said plurality of injectors and supplied by said fuel delivery means with said fuel at high pressure;

wherein each said storage volume includes an inlet connector directly supplied by said fuel delivery means, and an outlet connector directly converging into a common return line for return of the fuel coming out from each said outlet connectors to said tank; and wherein said return line is provided with a pressure regulator solenoid valve and a pressure transducer detecting the pressure of fuel in said return line upstream of said solenoid valve; a control unit being provided for controlling said solenoid valve according to the operating conditions of said engine and in response to pressure detected by said pressure transducer and so as to enable a continuous flow of the fuel through the storage volumes.

2. The system according to claim 1, wherein each one of said storage volumes is disposed inside a corresponding one of said injector.

3. The system according to claims 1 or 2, wherein each one of said injectors further comprise a first outlet section for outlet of said fuel toward the respective combustion chamber of the engine, and a second outlet section for outlet of said fuel toward said tank.

4. The system according to claim 2, wherein each one of said injectors comprises:

a hollow body connected to a nozzle carrying a fuel injection chamber communicating with said first outlet section, said inlet connector communicates with a hole of an appendage of said hollow body, and a servo-valve having a fuel control chamber provided with said second outlet section, said injection chamber and said control chamber being supplied with said fuel at high pressure through said inlet connector;

wherein said elementary storage volume is defined by a chamber of the appendage, and by an annular grove provided in said hollow body and communicating with the chamber of said appendage, said annular groove also communicating with both said injection chamber and said control chamber.

5. The system according to claim 4, wherein each outlet connector communicates with a second hole of a second appendage of said hollow body, said second hole also communicating also with said injection chamber and said control chamber, said storage volume also comprising another chamber of said second appendage, said annular grove also communicating with said second hole.

* * * * *